United States Patent [19]

Clark

[11] Patent Number: 4,736,877

[45] Date of Patent: Apr. 12, 1988

[54] GOLF ACCESSORY HOLDER

[76] Inventor: George R. Clark, 2512 26th St., Snyder, Tex. 79549

[21] Appl. No.: 28,979

[22] Filed: Mar. 23, 1987

[51] Int. Cl.[4] ..... A45F 5/00

[52] U.S. Cl. ..... 224/252; 224/918; 224/183; 224/249; 224/242; 206/315.1; 273/32 A; 273/32 B; 273/32 D; D3/104

[58] Field of Search ..... 224/918, 183, 242, 247, 224/248, 249, 252, 253, 268; 206/315.1; D3/104; 273/32 R, 32 A, 32 B, 32 D

[56] References Cited

U.S. PATENT DOCUMENTS

| | | | |
|---|---|---|---|
| D. 252,422 | 7/1979 | Gillenwater | D3/104 |
| D. 274,830 | 7/1984 | Lynch | D21/234 |
| D. 277,900 | 3/1985 | Reed | D3/104 |
| 2,233,802 | 3/1941 | Ludwick | 224/183 |
| 2,452,400 | 10/1948 | Stevens | 224/184 |
| 2,784,720 | 3/1957 | Royle | 224/252 X |
| 3,136,547 | 6/1964 | Schaper | 224/918 X |
| 3,139,690 | 7/1964 | Hait | 224/918 X |
| 3,298,579 | 1/1967 | Smith | 224/183 |
| 3,620,426 | 11/1971 | Hatch | 224/268 |
| 3,674,189 | 7/1972 | Walbeck | 224/918 X |
| 3,744,542 | 7/1973 | Stephens et al. | 150/52 R |
| 3,753,519 | 8/1973 | Gammon | 224/918 |
| 3,819,095 | 6/1974 | Snyder | 224/248 |
| 3,923,215 | 12/1975 | Suzuki | 224/183 |
| 4,081,114 | 3/1978 | Inoue | 224/252 X |
| 4,129,237 | 12/1978 | Grinder | 224/252 |
| 4,325,504 | 4/1982 | Amani | 224/183 |
| 4,475,676 | 10/1984 | Smith | 224/247 |
| 4,498,612 | 2/1985 | Geekie, Jr. | 224/163 |
| 4,645,105 | 2/1987 | Plumbridge | 224/269 |

FOREIGN PATENT DOCUMENTS

| | | | |
|---|---|---|---|
| 823409 | 11/1959 | United Kingdom | 224/252 |

*Primary Examiner*—Henry J. Recla
*Assistant Examiner*—Ernest G. Cusick
*Attorney, Agent, or Firm*—Wendell Coffee

[57] ABSTRACT

A golf accessory holder is made rectangular from a metal plate. A magnet is attached to the plate with a rivet. Two pole pieces are bent outward from the plate to protect the magnet and to hold a golf tool. Two fingers in the middle of the plate hold a marker disc. Two tee clips hold tees with a stop bent from the plate to align them. Belt clips on the back of the plate are provided to hold the plate to the belt of the golfer.

1 Claim, 1 Drawing Sheet

GOLF ACCESSORY HOLDER

CROSS REFERENCE TO RELATED APPLICATION

None.

RIGHTS TO INVENTIONS UNDER FEDERAL RESEARCH

There was no federally sponsored research and development concerning this invention.

BACKGROUND OF THE INVENTION (1) Field of the Invention

This invention relates to the sports and recreation art. Applicant submits that a golf pro is one having ordinary skill in this art.

(2) Description of the Related Art

Before this application was filed, the applicant was aware of the following United States patents:

| Inventor | U.S. Pat. No. |
|---|---|
| GILLENWATER | DES.252,422 |
| LYNCH | DES.274,830 |
| REED | DES.277,900 |
| LUDWICK | 3,233,802 |
| SMITH | 3,298,579 |
| HATCH | 3,620,426 |
| WALBECK | 3,674,189 |
| STEPHENS | 3,744,542 |
| SNYDER | 3,819,095 |
| GRINDER | 4,129,237 |
| SMITH | 4,475,676 |
| GEEKIE | 4,498,612 |

Applicant submits that the above patents show the desire and the need for a holder for golf accessories. Particularly, Applicant refers to the first column of LUDWICK and STEPHENS above.

Despite this apparent and expressed need, Applicant has searched golf pro shops and other places where golfing equipment and accessories are sold and has not been able to find a golf accessory holder on sale. Applicant takes this to mean that although there has been a long felt need, that none of the above suggested solutions have met with commercial success.

Applicant has noticed that on many golf courses, the ball marks which are indentations on the greens caused by a golf ball, have not been repaired. Golf tools are used to repair golf marks. Applicant feels that many golf pros, i.e., the people in charge of the golfing activities of a golf course, would be most eager to see an acceptable holder marketed. Applicant feels that if an acceptable holder were marketed, more people would be willing, and in fact would, repair ball marks because they would have a golf tool available.

SUMMARY OF THE INVENTION (1) Progressive Contribution to the Art

I have invented an accessory holder which will carry a golf tool, a ball marker, and two tees. This is primarily adapted to be worn on the belt or on top of the trousers if they are beltless, of a golfer. Also, this is particularly designed to be inexpensively made so that it can sell at a price so that all participants of the sport will own one. It is designed so that basically, it can be made by striking a piece of metal a successive number of times. It will then be necessary attach the holders (as by spot welding) for the tees and the magnet, which can be readily attached by a rivet.

(2) Objects of this Invention

An object of this invention is to provide a holder whereby a golfer may carry golf tees, ball marker, and golf tool.

Further objects are to achieve the above with a device that is sturdy, compact, durable, lightweight, simple, safe, efficient, ecologically compatible, and reliable, yet inexpensive and easy to manufacture, carry, and use.

The specific nature of the invention, as well as other objects, uses, and advantages thereof, will clearly appear from the following description and from the accompanying drawing, the different views of which are not scale drawings.

Figure 1:
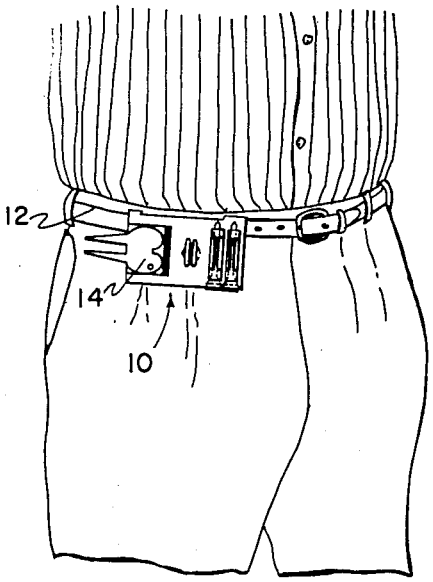
FIG. 1 is a perspective view of a portion of a golfer's torso showing an embodiment of the invention attached to a trousers' belt.

As an aid to correlating the terms of the claims to the exemplary drawing, the following catalog of elements and steps is provided:

10: accessory holder
12: belt
14: golf tool
16: marker disc
18: tees
20: spike
22: front face
24: plate
26: back face
28: top edge
30: bottom edge
32: left side edge
34: right side edge
36: fingers
38: distal end
40: proximal part
42: edge pole piece
44: interior pole piece
46: slot
48: hole
50: magnet
52: inboard tee clip
54: outboard tee clip
56: back plate
58: wings
60: tee stop
62: wide belt clip
64: outward edge turn
66: slot
68: marrow belt clip
70: distal tip

DESCRIPTION OF THE PREFERRED EMBODIMENT

Referring to the drawings, there may be seen, as particularly represented in FIG. 1, accessory holder 10 attached to a golfer's belt 12. In FIG. 1, the accessories, specifically golf tool 14, marker disc 16, and tees 18 are shown in full line.

Figure 2:
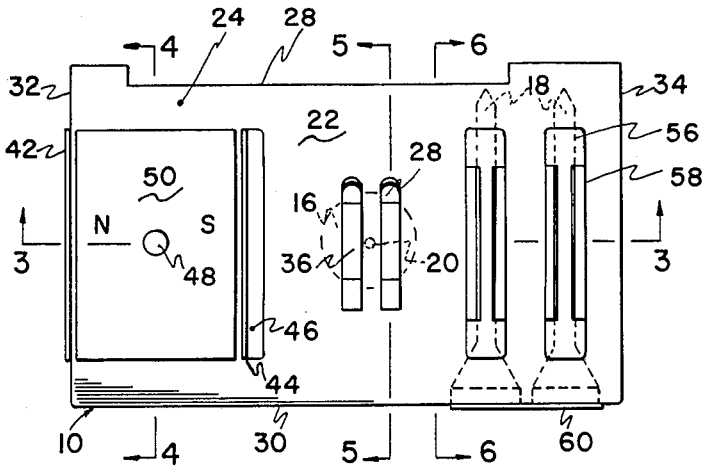
FIG. 2 is a front elevational view of an embodiment of the invention with a marker and tees shown in phantom.

In the front elevational view thereof, the golf tool is not shown, and the marker disc 16 and tees 18 are shown in phantom. The marker disc will have spike 20 extending from the center thereof, which as seen in FIG. 2, will be projecting away from front face 22 of plate 24 of the accessory holder 10. The spike 20 is to aid in holding the marker disc 16 in its position when marking a ball location on the green.

The plate 24 wil have back face 26 as well as the front face 22. Also, the plate will have top edge 28, bottom edge 30, left side 32, and right side 34. The plate 24 is preferably made of metal such as cold rolled steel; however, it will be understood that it could be made of other material as long as it was sufficiently resilient and had magnetic properties and had the other necessary qualities. The plate is flat and rectangular. The side edges 32 and 34 are shorter than the top and bottom edges 28 and 30.

Figure 7:
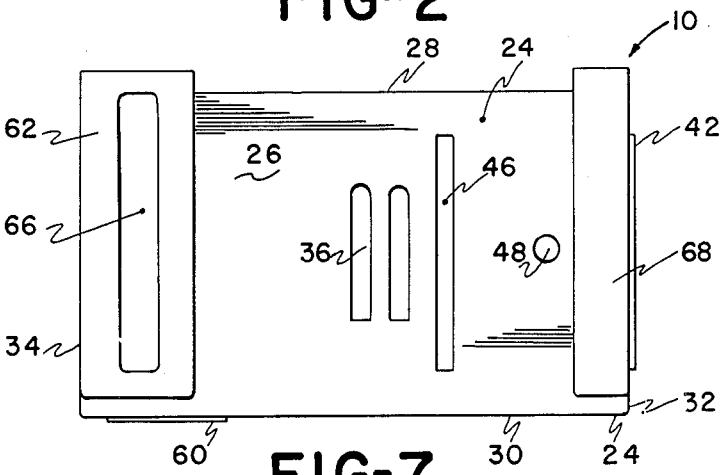
FIG. 7 is a back elevational view thereof.
Figure 4:
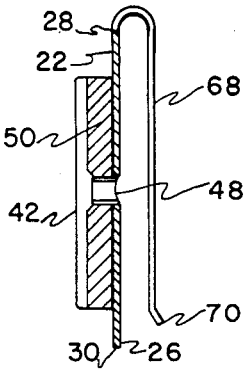
FIG. 4 is a sectional view taken substantially on lines 4–4 of FIG. 2.
Figure 3:
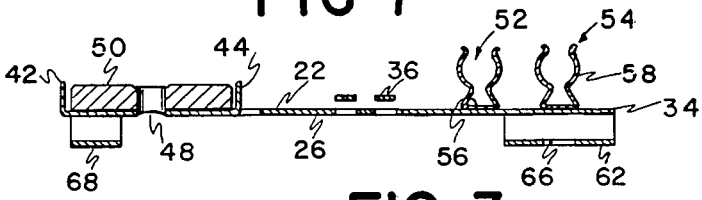
FIG. 3 is a sectional view taken substantially on lines 3—3 of FIG. 2.
Figure 5:
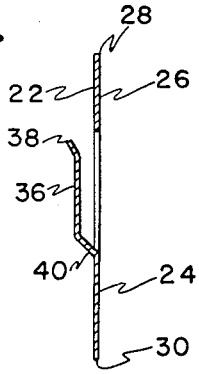
FIG. 5 is a sectional view taken substantially on lines 5—5 of FIG. 2.
Figure 6:
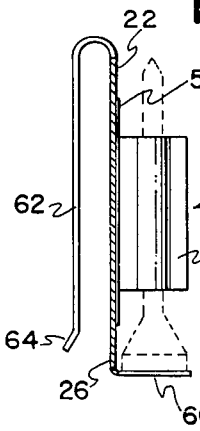
FIG. 6 is a sectional view taken substantially on lines 6—6 of FIG. 2 with a tee shown in phantom.

Near the center of the face 22, two marker fingers 36 are struck from the flat plate, as seen in FIGS. 3 and 5. The fingers 36 are parallel to the side edges 32 and 34. These fingers are spaced apart and are shaped to firmly hold marker disc 16 between the fingers 36 and the front face 22. They are spaced apart so that the spike 20 of the disc 16 can project between the fingers 36 as seen in FIG. 2. The distal end 28 of the fingers 36 are bent outward or projected from the front face 22 as seen in FIG. 5. The proximal or bottom part 40 of the fingers will be attached to the middle of the plate 24. As seen in FIG. 7, there will be slots or holes in the plate 24 where the fingers 36 are projected forward.

A tab on the left side edge 32 of the plate 24 is bent toward the front face 22 at a right angle to the front face to form edge magnetic pole piece 42. Interior magnetic pole piece 44 is formed by projecting the metal from slot 46 in the plate 24. The pole pieces 42 and 44 are parallel to the side edges 32 and 34. A hole 48 is punched in the center of the space formed by the pole pieces 42 and 44. A rivet is placed through the hole to hold magnet 50 in place. As marked in FIG. 2, the magnet will have one pole, such as the north pole, adjacent to pole piece 42, and another pole, such as the south pole, adjacent to pole piece 44. As seen in FIG. 3, the pole pieces 42 and 44 extend from the front face further than the magnet 50. Therefore, with the construction as described, the golf tool 14, which is of magnetic iron, can be held securely to the pole pieces 42 and 44. The magnet 50 is near the left side edge 32 and is attached to the front face 22 of the plate 24.

Inboard tee clip 52 and outboard tee clip 54 are identical and are attached as by spot welding to the front face 22 of the accessory holder 10.

Each of the tee holders is made of a resilient material, preferably metal of less thickness than the thickness of plate 24. Each clip has a back plate 56 which is flat against the front face 22. Each clip will have two wings 58 or concave spring sides which extend outward from the front face 22. The wings are a part of the same piece of metal as the back plate 56. Tee clips 52 and 54 resemble fuse holders, except the wings extend along the main center area of the back plate 56 instead of at both ends, as customary with fuse holders. I.e., the wings have interior concave portions to snugly and firmly hold the tees 18 in place. A tab on the bottom edge 30 is bent upward to form tee stop 60 along the bottom edge 30. Therefore, it may be seen that although the wings 58 hold the tees in place, the stop 60 prevent the tees from dropping down and keep the tees 18 well aligned.

Wide belt clip 62 is formed from a tab which extends from the top edge 28 having one side or edge aligned with right side edge 34. The wide belt clip 62 is bent so it is near and parallel to the back face 26. On the bottom or distal end, it will have an outward turned edge 64 so that the accessory holder 10 can be easily placed upon the golfer's belt 12. The wide clip 62 has slot 66 in the middle thereof. The slot 66 will be on the back aligned with the back plate 56 of the outboard tee holder 54. The outboard tee holder 54 will be on the outboard or nearer the right side edge 34 than the inboard tee holder 52. The wide belt clip 62 will be manufactured before the tee clips are attached. Therefore, the slot 66 permits the spot welding of the tee holder 54 to the plate 24.

Narrow belt clip 68 is formed from a tab which extends from the top edge 28 along the left side edge 32. When formed, it also will be parallel to the back face 28 and will also have outwardly projecting bottom or distal tip 70 so that it too will fit easily over the belt 12. It is narrow so that it does not cover the hole 48 so that the magnet 50 may be riveted to the plate 24 after the narrow clip 68 has been formed.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

The magnet may be attached to the plate by other means such as adhesive.

SUBJECT MATTER CLAIMED FOR PROTECTION

I claim as my invention:

1. A golf accessories holder comprising:
   a. a flat rectangular iron plate having:
      i. a front face,
      ii. a back face,
      iii. a right side edge,
      iv. a left side edge,
      v. a top edge, and
      vi. a bottom edge,
      vii. the side edges being shorter than the top and bottom edges,
   b. two marker fingers, each having a distal end and struck outwardly from the plate,
   c. said marker fingers extending parallel to the sides and generally parallel to the front face,
   d. a marker disc firmly held between the fingers and the front face,
   e. a spike on the marker disc extending coaxially from the disc,
   f. said spike extending between the two fingers, g. the distal ends of the fingers are bent outward away from the front face, h. a tab on the left side edge of the plate bent toward the front face to form an edge magnetic pole piece, j. an interior magnetic pole piece struck from the plate and bent outward from the front face, k. said interior pole piece is parallel to the edge pole piece, m. a magnet having two poles attached to the front face, n. one pole of the magnet adjacent one pole piece, and the other pole adjacent the other pole piece, o. said pole pieces extending from the front face further than the magnet, p. a golf tool magnetically attached to the plate by direct contact to the two pole pieces, q. an outboard tee clip and an inboard tee clip, r. each tee clip made of a resilient metal of less thickness than the thickness of the plate s. each clip includes a back plate which is flat against the front face of the plate, t. each clip has two wings, u. each wing extends outward from the front face, v. the wings are concave on the interior surface, w. the outboard clip attached to the front face of the plate welded to the front face of the plate with the outboard clip adjacent to the right edge of the plate, x. the inboard clip welded to the front face of the plate spaced from and parallel to the outboard clip, y. a tab on the bottom edge of the plate, z. said tab bent outward so it extends at right angles to the front face and forms a stop, aa. a tee in each clip with one end of the tee resting against the stop, bb. a wide belt clip is formed from a tab of metal having a distal tip which extends from the top edge adjacent to the right side edge, cc. the wide belt clip having a distal tip bent down parallel to the back face with the distal tip thereof turned away from the back face, dd. a slot in the wide belt clip immediately behind the back plate of the outboard tee clip, and ee. a narrow belt clip formed from a tab having a distal tip which extends from top edge adjacent to the left side edge, ff. the narrow belt clip is parallel to the back face, and the distal tip thereof is bent outward and away from the back face.

* * * * *